US010669131B2

(12) United States Patent
Oka et al.

(10) Patent No.: US 10,669,131 B2
(45) Date of Patent: Jun. 2, 2020

(54) CONSTRUCTION MACHINE EQUIPPED WITH BOOM

(71) Applicant: KOBELCO CONSTRUCTION MACHINERY CO., LTD., Hiroshima-shi (JP)

(72) Inventors: Takahiro Oka, Hyogo (JP); Hiroyuki Otsuka, Hyogo (JP); Shoji Watanabe, Hyogo (JP); Daisuke Takaoka, Hyogo (JP); Tetsuya Kobatake, Hyogo (JP); Shingo Kurihara, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 410 days.

(21) Appl. No.: 15/804,272

(22) Filed: Nov. 6, 2017

(65) Prior Publication Data

US 2018/0134528 A1 May 17, 2018

(30) Foreign Application Priority Data

Nov. 14, 2016 (JP) ..... 2016-221790

(51) Int. Cl.
*B66C 13/20* (2006.01)
*B66C 23/92* (2006.01)

(52) U.S. Cl.
CPC ..... *B66C 13/20* (2013.01); *B66C 23/92* (2013.01)

(58) Field of Classification Search
CPC . B66C 13/20; B66C 23/36; B66C 23/82–828; B66C 23/92
See application file for complete search history.

(56) References Cited

U.S. PATENT DOCUMENTS 2,840,244 A * 6/1958 Thomas, Jr. ..... B66C 23/92 212/280
4,446,976 A * 5/1984 Imerman ..... B66C 23/78 212/175
4,658,970 A * 4/1987 Oliphant ..... B66C 23/84 188/379
5,676,264 A * 10/1997 Wilson ..... B66C 23/92 212/280

FOREIGN PATENT DOCUMENTS

JP 2012-51713 3/2012

* cited by examiner

*Primary Examiner* — Sang K Kim
*Assistant Examiner* — Nathaniel L Adams
(74) *Attorney, Agent, or Firm* — Oblon, McClelland, Maier & Neustadt, L.L.P.

(57) ABSTRACT

Provided is a construction machine capable of suppressing deformation of a boom in a simple configuration and at low costs. The construction machine includes a pair of backstops having respective hydraulic cylinders; a supply device which supplies the hydraulic cylinders with hydraulic fluid; a deformation sensing device which senses deformation of the boom; and a control device which controls the supply device so as to make a thrust of the hydraulic cylinder of one backstop having a larger pressing force, out of the pair of backstops, be larger than a thrust of the hydraulic cylinder of the other backstop, the pressing force being applied due to the deformation of the boom.

4 Claims, 6 Drawing Sheets

CONSTRUCTION MACHINE EQUIPPED WITH BOOM

TECHNICAL FIELD

The present invention relates to a construction machine including a boom and a back stop device for preventing the boom from falling backward.

BACKGROUND ART

Known is a construction machine including a boom, for example, a travelling-type crane, the construction machine including a slewing body supporting the boom so as to allow the boom to be raised and lowered. Slewing the slewing body and the boom supported on the slewing body enables omnidirectional craning work in an entire periphery around an own machine to be performed, and raising and lowering the boom allows a crane operation at a high position or a position far from the slewing body to be done. These enable a load operation to be done in a three dimensional space.

Raising the boom causes a force in the boom to compress the boom itself. Furthermore, application of lateral force such as wind power or slewing inertial force to the boom generates large lateral bending moment to bend the boom laterally, thereby causing the boom to be laterally deflected. Besides, the boom may have not only the lateral deflection but also torsion. Such lateral deflection or torsion involves change of the boom in its shape, namely, deformation thereof.

Japanese Unexamined Patent Publication No. 2012-51713 discloses a technique to suppress such deformation of a boom. The technique includes attaching a lateral mast crossing a longitudinal direction of a main boom to extend in a lateral direction, and extending a tension rope between both ends of the lateral mast and a sheave provided at a front end of the main boom.

The technique, however, requires attachment of various members including the lateral mast, the sheave, and the tension rope to the main boom, and adjustment thereof, thus involving an increase in scale of facilities and an increase in costs.

SUMMARY OF INVENTION

An object of the present invention is to provide a construction machine including a boom, the construction machine being capable of suppressing deformation of the boom with a simple configuration and at low costs.

Provided is a construction machine including: a base; a slewing body mounted on the base so as to be slewable; a boom pivotally supported on the slewing body so as to be raised and lowered, the boom having a back surface; a pair of right and left backstops located between the back surface of the boom and the slewing body, each of the right and left backstops having a hydraulic cylinder which generates a thrust that pushes the boom forward in order to prevent the boom from falling backward, each of the backstops having a first end portion connected to the slewing body and a second end portion to be connected to the boom, the second end portion being opposite to the first end portion; a supply device which supplies each hydraulic cylinder of the pair of backstops with hydraulic fluid for generating the thrust; a deformation sensing device which senses deformation of the boom; and a control device which controls the supply device such that the supply device supplies hydraulic fluid so as to make a first thrust of the hydraulic cylinder of one backstop of the pair of back stops be larger than a second thrust of the hydraulic cylinder of the other backstop of the pair of back stops, the one backstop receiving a larger pressing force applied due to deformation of the boom than the pressing force applied to the other backstop, the deformation being sensed by the deformation sensing device.

DESCRIPTION OF EMBODIMENTS

In the following, a preferred embodiment of the present invention will be described with reference to FIG. 1 to FIG. 6.

Figure 1:
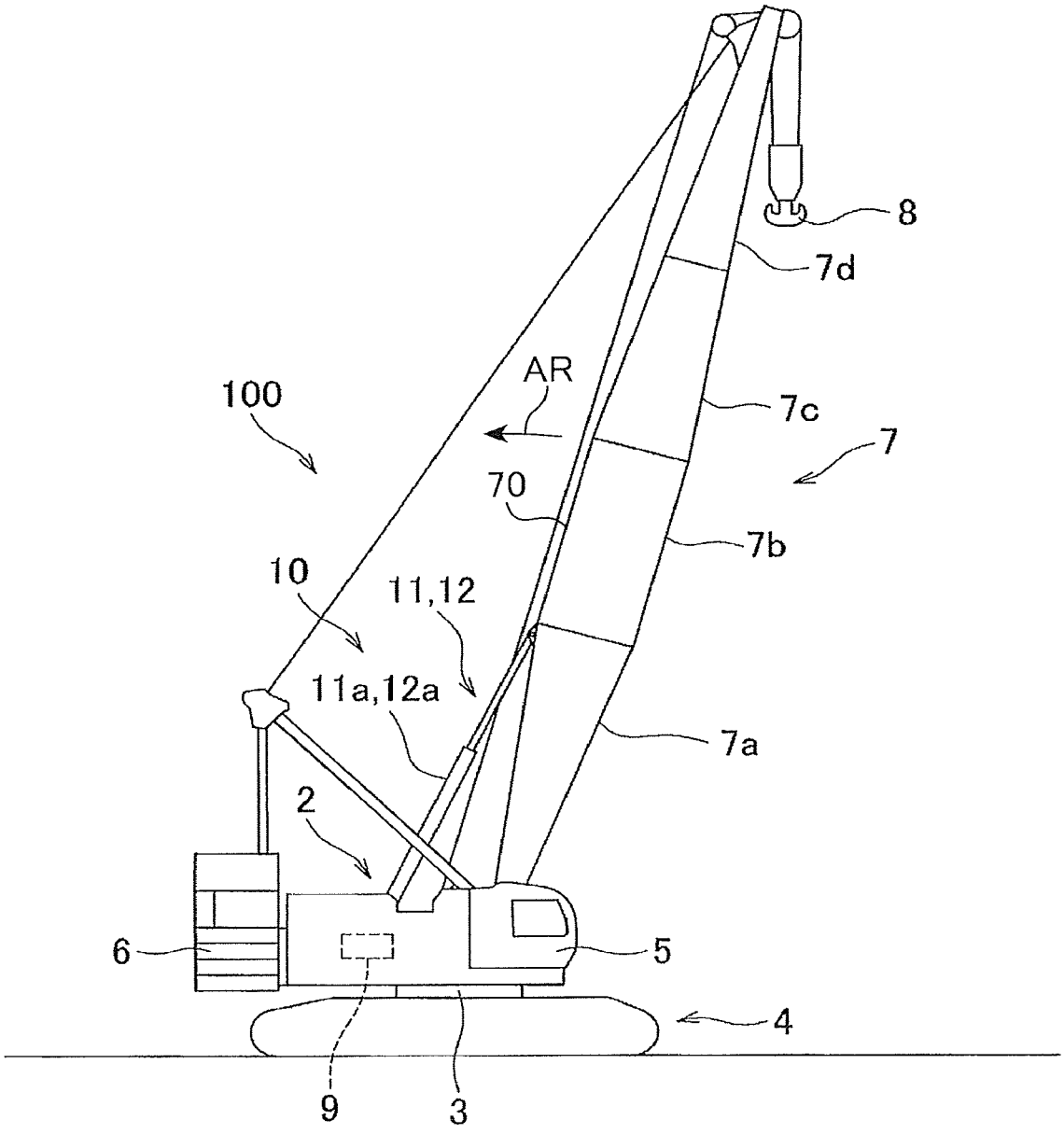
FIG. 1 is a side view showing a crawler crane which is a construction machine according to one embodiment of the present invention.

FIG. 1 shows a crawler crane 100, which is a construction machine according to the present embodiment. The crawler crane 100 includes an upper slewing body 2, a slewing bearing 3, a lower travelling body 4 as a base, a cab 5 as a driver's room, a counter weight 6, a boom 7, and a hook 8.

The upper slewing body 2 is mounted on the lower travelling body 4 through the slewing bearing 3 so as to be slewable. The cab 5 and the counter weight 6 are provided at a front portion and a rear portion of the upper slewing body 2, respectively.

The boom 7 is pivotally supported on the front portion of the upper slewing body 2 so as to be raised and lowered. The boom 7 has a back surface 70. The back surface 70 is one of side surfaces of the boom 7, the hack surface 70 being a side surface facing to a rotational direction for raising the boom 7 as indicated by an arrow AR in FIG. 1, that is, a side surface facing rearward. The boom 7 has a lattice structure. The boom 7 includes a lower boom 7*a*, two intermediate booms 7*b* and 7*c*, and an upper boom 7*d*. The intermediate booms 7*b* and 7*c* can be omitted. Alternatively, the boom 7 may have one, or three or more intermediate booms.

Figure 5:
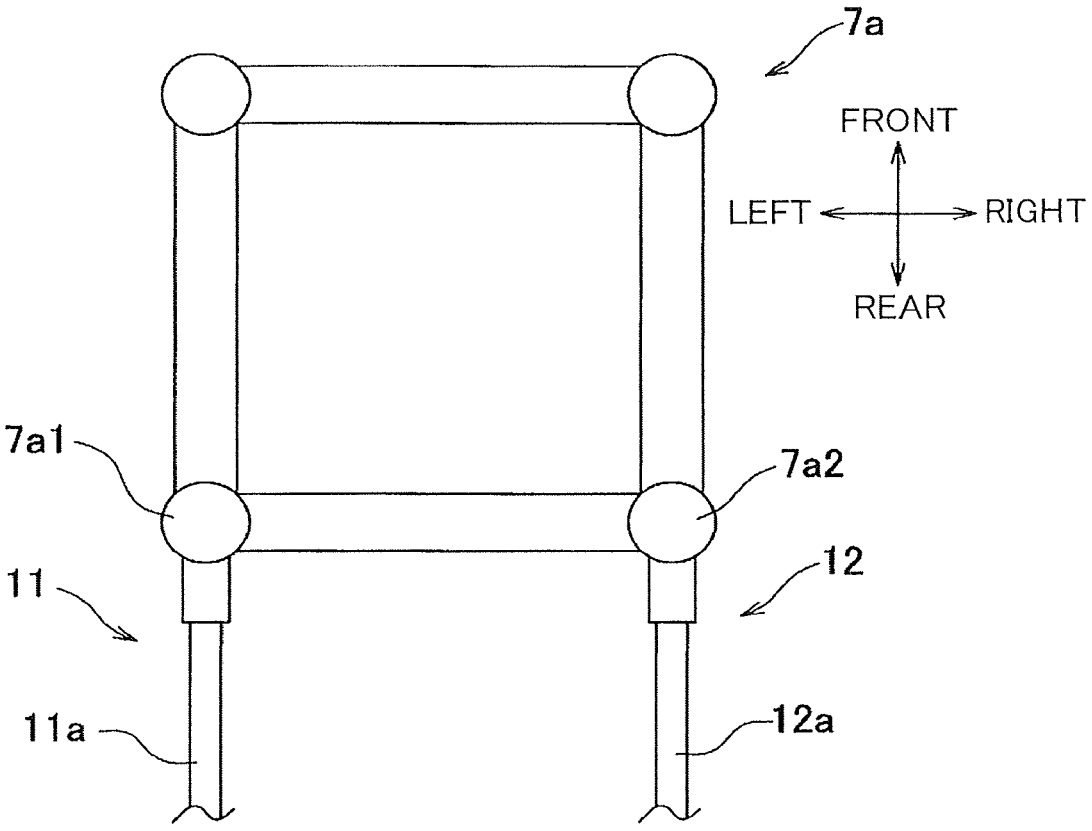
FIG. 5 is a plan view showing a part of the lower boom and the pair of backstops connected to the part of the lower boom when the boom has no torsion.
Figure 6:
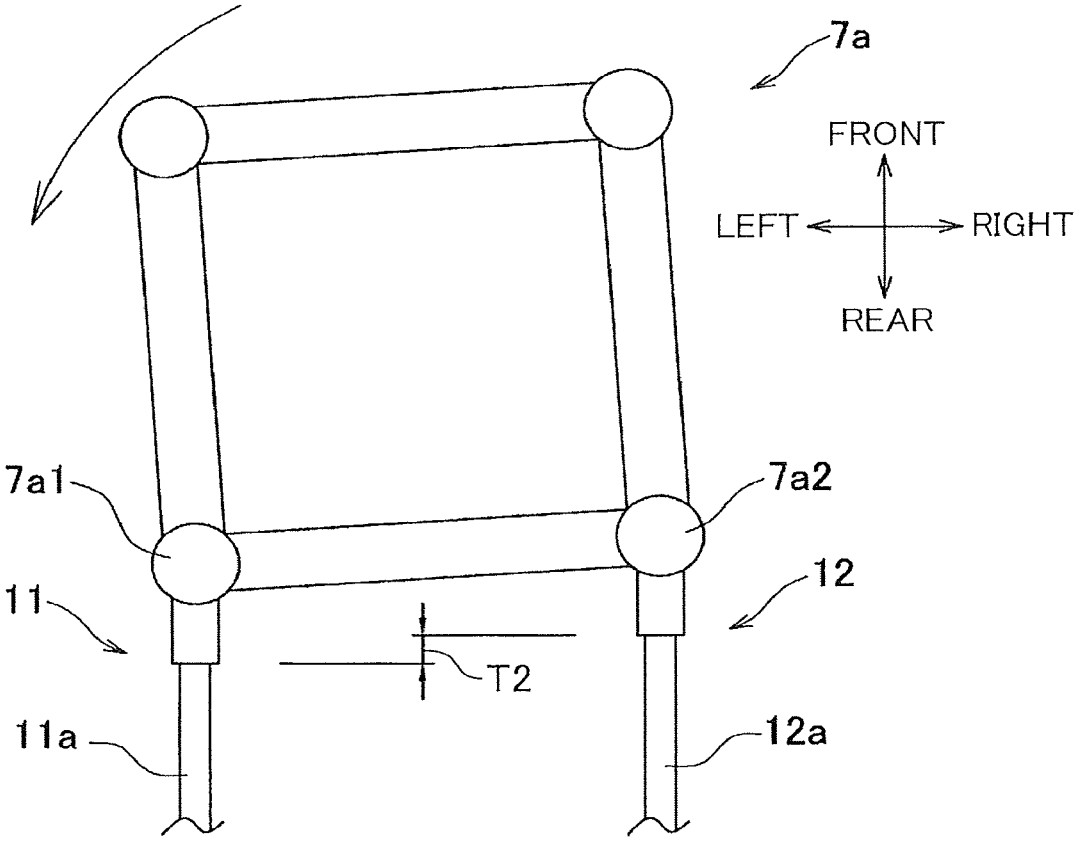
FIG. 6 is a plan view showing a part of the lower boom and the pair of backstops connected to the part of the lower boom when the boom has counterclockwise torsion.

FIGS. 5 and 6 show, for convenience, only a part of members constituting the lower boom 7*a*, namely, four pillars (for example, main pipes) and a plurality of connection rods interconnecting the pillars. The structure of the boom according to the invention is unlimited. For example, the boom according to the present invention may have a structure other than a lattice structure.

The hook 8 is suspended through a rope from the boom 7, specifically, from a front end of the upper boom 7*d*. The crawler crane 100 is capable of conducting loading and unloading work of lifting up a hung load by the hook 8, or other work. The upper slewing body 2 is equipped with an engine 9, and a hydraulic pump 22 (see FIG. 2) driven by the engine 9. The hydraulic pump 22 is driven by the engine 9 to supply a plurality of hydraulic motors with hydraulic fluid. The plurality of hydraulic motors includes, for example, a travelling motor for causing the lower travelling body 4 to travel, a slewing motor for slewing the upper slewing body 2, and a raising and lowering motor included in a winch for raising and lowering the boom 7.

Figure 2:
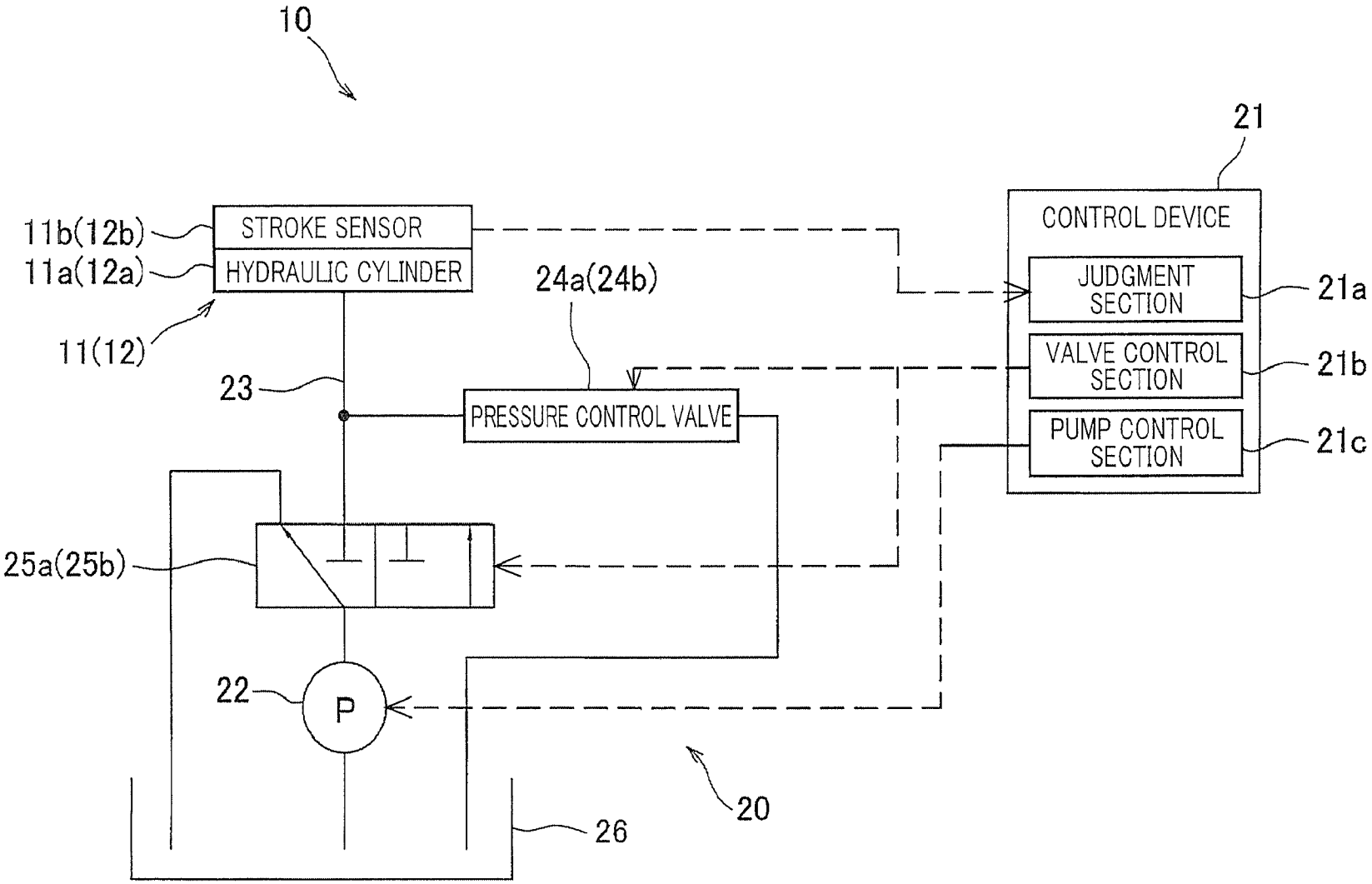
FIG. 2 is a diagram showing a hydraulic control circuit aboard the construction machine shown in FIG. 1.

The crawler crane 100 further includes a backstop device 10 as shown in FIG. 1 and FIG. 2. The backstop device 10 includes a pair of right and left backstops 11 and 12, a supply device 20 shown in FIG. 2, and a control device 21 shown in FIG. 2.

The pair of backstops 11 and 12 is provided between the back surface 70 of the boom 7 and the upper slewing body 2. The backstops 11 and 12 include respective hydraulic cylinders 11*a* and 12*a*. Each of the hydraulic cylinders 11*a* and 12*a* generates a thrust to push the boom 7 forward in order to prevent the boom 7 from falling backward. The hydraulic cylinders 11*a* and 12*a* have the same configuration.

Figure 3:
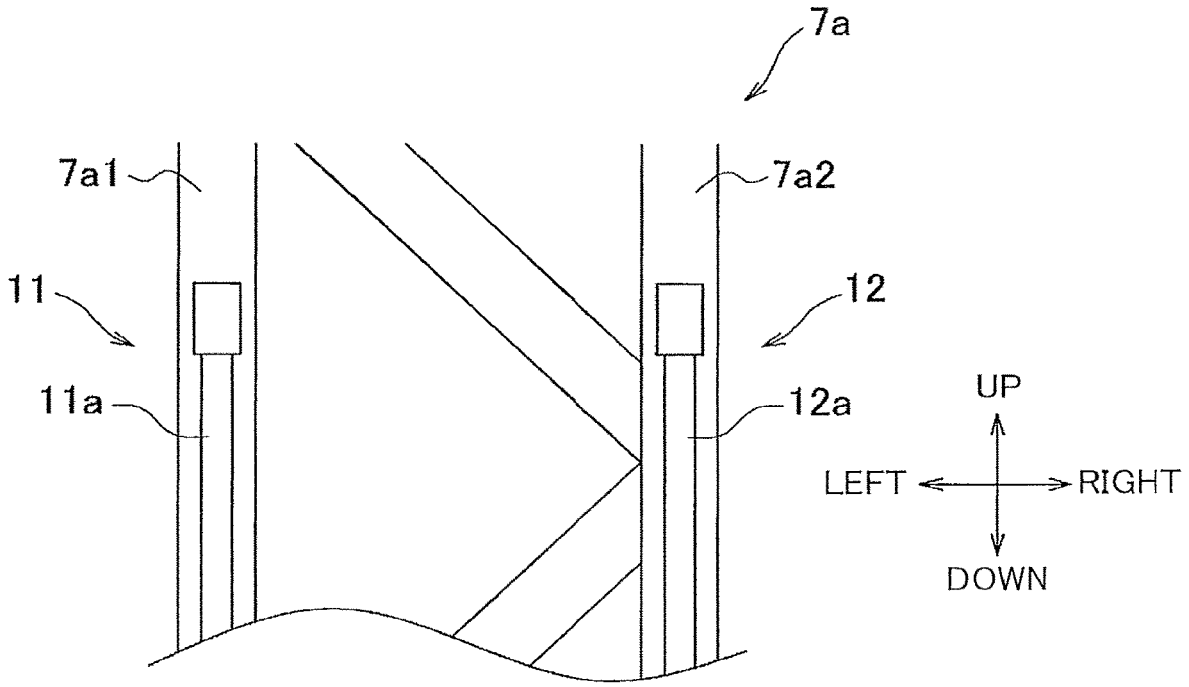
FIG. 3 is an expanded view showing main parts of a back surface of a lower boom configuring a boom in the construction machine and a pair of backstops attached to the back surface, in a state where the boom has no lateral deflection.
Figure 4:
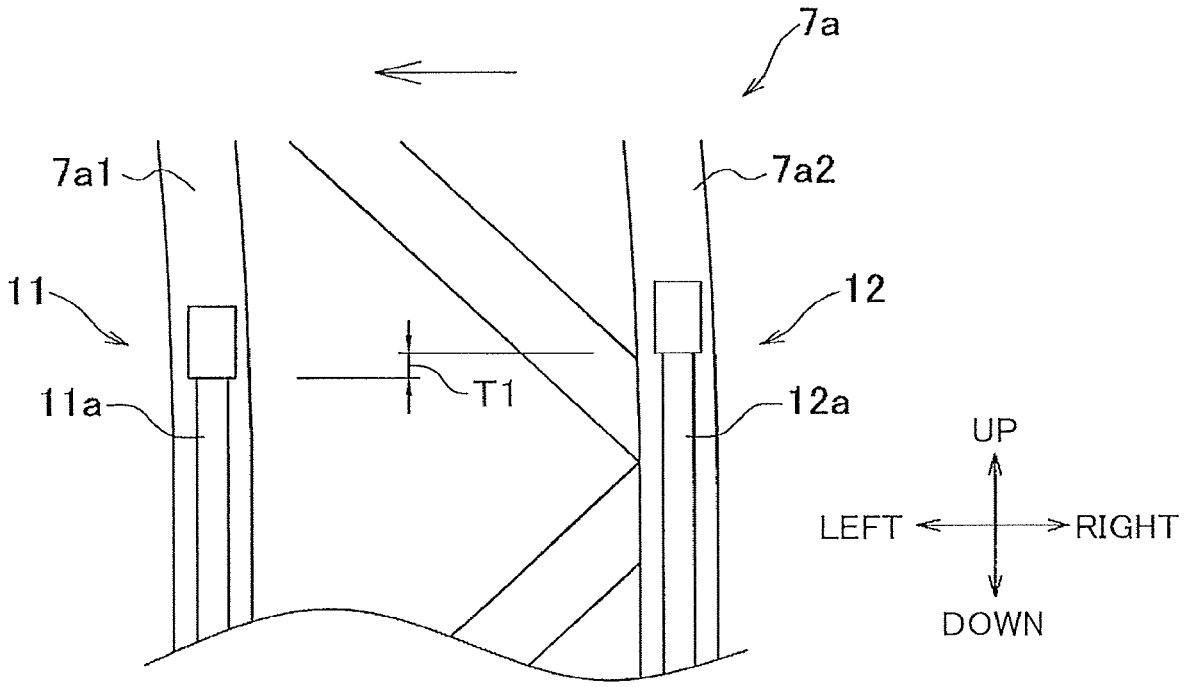
FIG. 4 is an expanded view showing main parts of the back surface of the lower boom configuring the boom in the construction machine and the pair of backstops connected to the back surface, in a state where the boom has leftward lateral deflection.

The hydraulic cylinders 11*a* and 12*a* are spaced in a right and left direction as shown in FIG. 3 and FIG. 4. The hydraulic cylinder 11*a*, which is one of the hydraulic cylinders 11*a* and 12*a* and constitutes the backstop 11, has a lower end which is a first end portion to be connected to the upper slewing body 2, and an upper end which is a second end portion to be connected to a left pillar 7*a*1 (left side end portion) constituting the back surface 70 in the lower boom 7*a*, the second end portion being opposite to the first end portion. The hydraulic cylinder 12*a* constituting the backstop 12 has a lower end which is a first end portion to be connected to the upper slewing body 2, and an upper end which is a second end portion to be connected to a right pillar 7*a*2 (right side end portion) constituting the back surface 70, in the lower boom 7*a*, the second end portion being opposite to the first end portion. Respective connection positions at which respective upper ends of the two hydraulic cylinders 11*a* and 12*a* are connected to the back surface 70 are coincident with each other both in an up-down direction and a front-rear direction. Respective positions at which respective lower ends of the two hydraulic cylinders 11*a* and 12*a* are connected to the upper slewing body 2 are also coincident with each other both in the up-down direction and the front-read direction. The upper ends of the hydraulic cylinders 11*a* and 12*a* may be connected to the boom 7 so as to be separatable from the boom 7, or the lower ends of the hydraulic cylinders 11*a* and 12*a* can be attached to the upper slewing body 2 so as to be separatable from the upper slewing body 2, as long as the hydraulic cylinders 11*a* and 12*a* are allowed to apply respective thrusts of the hydraulic cylinders 11*a* and 12*a* to the boom 7 in the state where the boom 7 has be raised until the raising and lowering angle reaches an angle not less than a predetermined angle.

The backstop devices 11 and 12 further have respective stroke sensors 11*b* and 12*b* for sensing respective strokes of the hydraulic cylinders 11*a* and 12*a*. As the stroke sensors 11*b* and 12*b*, can be used known stroke sensors. The stroke sensors 11*b* and 12*b* according to the present embodiment have respective rollers which are arranged so as to be in contact with respective pistons of the hydraulic cylinders 11*a* and 12*a* and convert linear motion of the pistons into rotational motion of the rollers, and respective rotary encoders connected to the rollers to generate signals indicative of stroke values of the hydraulic cylinders 11*a* and 12*a* and input the signals to the control device 21. The stroke sensors 11*b* and 12*b* can have any configuration that enables stroke values of the hydraulic cylinders 11*a* and 12*a* to be sensed and enables signals indicative of stroke values to be input to the control device 21, not limited to a specific configuration. In addition to the hydraulic cylinders 11*a* and 12*a*, the backstops 11 and 12 may further include shock absorber (e.g., a spring shock absorber) provided at respective one ends of the hydraulic cylinders 11*a* and 12*a*.

The supply device 20, which is a device capable of supplying hydraulic fluid for causing each of the hydraulic cylinders 11*a* and 12*a* to generate the thrust, includes the hydraulic pump 22, includes a hydraulic pipe 23, pressure control valves 24*a* and 24*b*, electromagnetic selector valves 25*a* and 25*b*, and a tank 26. FIG. 2 shows a hydraulic circuit for the backstop 11, which is one of the pair of backstops 11 and 12, and the backstop 12 is provided with the same hydraulic circuit as the hydraulic circuit provided in the backstop 11. Hence, a part of components of the hydraulic circuit related to the backstop 12, other than the common components, namely, the hydraulic pump 22, the hydraulic pipe 23, and the tank 26, are indicated by reference numbers in parentheses in FIG. 2.

The hydraulic pump 22 supplies hydraulic fluid to the hydraulic cylinders 11*a* and 12*a* through respective hydraulic pipes 23. The hydraulic pump 22 is configured to discharge hydraulic fluid with a pressure higher than set pressures of the pressure control valves 24*a* and 24*b*. The pressure control valves 24*a* and 24*b* are known relief valves which open to let a part of hydraulic fluid to the tank 26 when respective internal pressures of the hydraulic cylinders 11*a* and 12*a* are higher than the respective pressures given to the pressure control valves 24*a* and 24*b*. The set pressure of each of the pressure control valves 24*a* and 24*b* can be changed by a command signal input from the control device 21. The control device 21 controls the set pressures of the pressure control valves 24*a* and 24*b* so as to increase the set pressures with increase in the raising and lowering angle of the boom 7. At this time, the set pressures of the pressure control valves 24*a* and 24*b* are set to be the same. This makes it possible to drive the hydraulic cylinders 11*a* and 12*a*, at a predetermined set pressure, through hydraulic fluid discharged from the hydraulic pump 22.

The electromagnetic selector valve 25*a* is switchable between a communication state of bringing the hydraulic pump 22 and the hydraulic cylinder 11*a* into communication with each other, and a shutoff state of shutting off the communication between the hydraulic pump 22 and the hydraulic cylinder 11*a*. FIG. 2 shows the electromagnetic selector valves 25*a* and 25*b* in the shutoff state. Switching of respective positions of valve bodies of the electromagnetic selector valves 25*a* and 25*b* shown in FIG. 2 from a position at the right side to a left side in FIG. 2 brings the electromagnetic selector valves 25*a* and 25*b* from the shutoff state into the communication state.

The control device 21 includes a judgment section 21*a*, a valve control section 21*b*, and a pump control section 21*c*.

The judgment section 21*a* judges which of pressing forces applied to the hydraulic cylinders 11*a* and 12*a* is larger, the pressing forces being applied due to the deformation of lateral deflection or torsion in the boom 7, on the basis of a signal indicative of a stroke value input from the stroke sensors 11*b* and 12*b*.

Here is described a state of the hydraulic cylinders 11*a* and 12*a* in the case of deformation of lateral deflection in the boom 7. For example, leftward lateral deflection of the boom 7 involves a leftward deflection of the pillar 7a1 of the boom as shown in FIG. 4 from no lateral deflection state as shown in FIG. 3. The deformation of the boom 7, including the deflection of the pillar 7a1, causes a pressing force to be applied to the hydraulic cylinder 11a, the pressing force being large enough to reduce a stroke of the hydraulic cylinder 11a. When the internal pressure of the hydraulic cylinder 11a thereby exceeds the set pressure of the pressure control valve 24a, the pressure control valve 24a is opened to let hydraulic fluid between the hydraulic cylinder 11a and the pressure control valve 24a to the tank 26. This makes the stroke of the hydraulic cylinder 11a be shorter by a length T1 than a stroke of the hydraulic cylinder 12a. Conversely, when rightward lateral deflection is caused in the boom 7 and the internal pressure of the hydraulic cylinder 12a thereby exceeds the set pressure of the pressure control valve 24b, the stroke of the hydraulic cylinder 12a becomes shorter than the stroke of the hydraulic cylinder 11a. The stroke sensors 11b and 12b, thus, configure a sensing device capable of sensing deformation of the boom 7 through the stroke value.

Next will be described a state of the hydraulic cylinders 11a and 12a in the case of deformation of torsion in the boom 7. For example, a torsion load acting on the front end side of the boom 7 in a direction to rotate the boom 7 about a central axis along the longitudinal direction of the boom 7 causes, in the boom 7, a torsion which displaces the pillar 7a1 from a position shown in FIG. 5 to a position shown in FIG. 6. The deformation of the boom 7, including the displacement of the pillar 7a1 involved by the torsion, generates such a large pressing force to the hydraulic cylinder 11a as to reduce the stroke of the hydraulic cylinder 11a. When the internal pressure of the hydraulic cylinder 11a thereby exceeds the set pressure of the pressure control valve 24a, the pressure control valve 24a is opened to let hydraulic fluid between the hydraulic cylinder 11a and the pressure control valve 24a to the tank 26. This makes the stroke of the hydraulic cylinder 11a be shorter by a length T2 than the stroke of the hydraulic cylinder 12a. Conversely, when a torsion which brings the pillar 7a2 into displacement to press the hydraulic cylinder 12a is caused in the boom 7 and the internal pressure of the hydraulic cylinder 11a thereby exceeds the set pressure of the pressure control valve 24a, the stroke of the hydraulic cylinder 12a becomes shorter than the stroke of the hydraulic cylinder 11a.

The respective stroke sensors 11b and 12b input respective signals indicative of such stroke values of the hydraulic cylinders 11a and 12a to the judgment section 21a of the control device 21, thereby enabling the judgment section 21a to judge which of pressing forces applied to the hydraulic cylinders 11a and 12a is larger, the pressing forces being applied due to the deformation of lateral deflection or torsion in the boom 7. Specifically, the judgment section 21a judges that a larger pressing force is applied to a hydraulic cylinder with a smaller detected stroke value, due to the deformation of lateral deflection or torsion in the boom 7. More specifically, no deformation of lateral deflection or torsion in the boom 7 makes the hydraulic cylinders 11a and 12a be substantially equal to each other, whereas deformation of lateral deflection or torsion in the boom 7 gives a difference large enough to exceed a predetermined range between respective stroke values: based on this, it is possible to sense deformation of lateral deflection or torsion in the boom 7. The predetermined range is a range smaller than an allowable difference between respective stroke values of the hydraulic cylinders 11a and 12a, the allowable difference corresponding to deformation of lateral deflection or torsion in the boom 7 within an allowable range.

The valve control section 21b controls the pressure control valves 24a and 24b so as to increase respective set pressures of the pressure control valves 24a and 24b with increase in the raising and lowering angle of the boom 7. In addition, when deformation of lateral deflection or torsion is caused in the boom 7, the valve control section 21b changes respective set pressures of the pressure control valves 24a and 24b into set pressures higher than the set pressures for the case of no deformation. Besides, the valve control section 21b controls selective switching of the electromagnetic selector valves 25a and 25b between the communication state and the shutoff state.

The pump control section 21c controls the hydraulic pump 22 so as to cause the hydraulic pump 22 to supply the hydraulic cylinders 11a and 12a with hydraulic fluid.

Subsequently will be described an action of the backstop device 10 in the case of deformation of lateral deflection in the boom 7. The following description includes an initial state, which means a state where: the boom 7 is raised to a predetermined raising and lowering angle; respective set pressures of the pressure control valves 24a and 24b are set to be a predetermined set pressure P1; and each of the electromagnetic selector valves 25a and 25b is switched to the shutoff state.

When the boom 7 is brought into deformation of lateral deflection in the initial state, the judgment section 21a judges which of pressing forces applied to the hydraulic cylinders 11a and 12a is larger, on the basis of the stroke values input from the stroke sensors 11b and 12b, the pressing forces being applied due to the deformation of the boom 7. When leftward lateral deflection is caused in the boom 7, the judgment section 21a judges that the pressing force applied to the hydraulic cylinder 11a is larger than the pressing force applied to the hydraulic cylinder 12a. Conversely, when rightward lateral deflection is caused in the boom 7, the judgment section 21a judges that the pressing force applied to the hydraulic cylinder 12a is larger than the pressing force applied to the hydraulic cylinder 11a.

The following description is about a state where the boom 7 is brought into leftward lateral deflection and the difference between respective stroke values of the hydraulic cylinders 11a and 12a is larger than the predetermined range. The control of the hydraulic cylinder 11a, the pressure control valve 24a, and the electromagnetic selector valve 25a for the case of deformation of rightward lateral deflection in the boom 7 can be just exchanged to the control of the hydraulic cylinder 12a, the pressure control valve 24b, and the electromagnetic selector valve 25b for the case of deformation of leftward lateral deflection in the boom 7; hence, detailed description of the former control will be omitted.

In the case of deformation of leftward lateral deflection in the boom 7, the valve control section 21b changes the set pressure of the pressure control valve 24a from the set pressure P1 in the initial state to a set pressure P2 higher than the set pressure P1. Furthermore, the valve control section 21b controls the electromagnetic selector valve 25a such that the electromagnetic selector valve 25a is brought from the current shutoff state into the communication state. On the other hand, the pump control section 21c controls the hydraulic pump 22 to supply the hydraulic cylinder 11a with hydraulic fluid. These controls makes it possible to supply hydraulic fluid to the hydraulic cylinder 11a with a pressure given an upper limit equal to the set pressure P2 to thereby provide the hydraulic cylinder 11a with an internal pressure great enough to resist a pressing force applied to the hydraulic cylinder 11*a* due to the deformation of lateral deflection in the boom 7. Thus making a thrust of the hydraulic cylinder 11*a* be larger than a thrust of the hydraulic cylinder 12*a* makes it possible to return the stroke the hydraulic cylinder 11*a* toward an original stroke.

The control device 21 controls the supply device 20 so as to confine the difference between the stroke value of the hydraulic cylinder 11*a* and the stroke value of the hydraulic cylinder 12*a* within the predetermined limit. The control device 21 according to the present embodiment controls the supply device 20 so as to bring the stroke value of the hydraulic cylinder 11*a* and the stroke value of the hydraulic cylinder 12*a* into coincidence with each other. In addition, if the stroke of the hydraulic cylinder 11*a* cannot be returned to an original stroke or a stroke close to the original stroke even with supply of hydraulic fluid to the hydraulic cylinder 11*a* with a pressure given an upper limit equal to the set pressure P2, the valve control section 21*b* of the control device 21 controls the pressure control valve 24*a* so as to change the set pressure of the pressure control valve 24*a* to a set pressure P3 larger than the set pressure P2. In summary, the valve control section 21*b* controls the supply device 20 to bring the stroke value of the hydraulic cylinder 11*a* into coincidence with the stroke value of the hydraulic cylinder 12*a* through increasing the set pressure of the pressure control valve 24*a*.

Such control of the supply device 20 as to increase the stroke value of the hydraulic cylinder 11*a* which is smaller than the stroke value of the hydraulic cylinder 12*a* enables deformation of the boom 7 to be effectively reduced against a pressing force applied to the backstop 11 by the boom 7 in deformation of lateral deflection.

At the point in time when the stroke values input from the stroke sensors 11*b* and 12*b* are brought into coincidence with each other (alternatively, at the point in time when the difference between respective strokes of the hydraulic cylinders 11*a* and 12*a* falls within the predetermined limit) by the control, the valve control section 21*b* switches the electromagnetic selector valve 25*a* to the shutoff state to hold the stroke of the hydraulic cylinder 11*a* so as to prevent the stroke from decrease.

Subsequently, at the time when the leftward lateral deflection caused in the boom 7 is sufficiently reduced or eliminated to make the stroke value of the hydraulic cylinder 12*a* input from the stroke sensor 12*b* to the control device 21 be smaller than the stroke value of the hydraulic cylinder 11*a*, the valve control section 21*b* controls the pressure control valve 24*a* so as to return the set pressure P2 (or P3) of the pressure control valve 24*a* to the set pressure P1. This causes the internal pressure of the hydraulic cylinder 11*a* to be also reduced to the set pressure P1, so that respective internal pressures of the hydraulic cylinders 11*a* and 12*a* become equal to each other. When the lateral deflection caused in the boom 7 is eliminated, the stroke values of both the hydraulic cylinders 11*a* and 12*a* also become equal to each other. The operation to be conducted for deformation of lateral deflection in the boom 7 is thus finished.

Next will be described the action of the backstop device 10 when the boom 7 is brought into deformation of torsion. The following description includes an initial state, which is a state where: the boom 7 has been raised to a predetermined raising and lowering angle; respective set pressures of the pressure control valves 24*a* and 24*b* are set to be the predetermined set pressure P1; and the electromagnetic selector valves 25*a* and 25*b* are switched to the shutoff state.

When the boom 7 is brought into deformation of torsion in the initial state, the judgment section 21*a* judges which of pressing forces applied to the hydraulic cylinders 11*a* and 12*a* due to the deformation of the boom 7 is larger, on the basis of the stroke values input from the stroke sensors 11*b* and 12*b*. The following description is about a case where the boom 7 is brought into such torsion that the pressing force applied to the hydraulic cylinder 12*a* is larger than that applied to the hydraulic cylinder 11*a* and the difference between respective stroke values of the hydraulic cylinders 11*a* and 12*a* exceeds the predetermined limit. The control of the hydraulic cylinder 12*a*, the pressure control valve 24*b*, and the electromagnetic selector valve 25*b* for the case where the boom 7 is brought into deformation of torsion so as to apply a larger pressing force to the hydraulic cylinder 12*a* than a pressing force to the hydraulic cylinder 12*a* can be just exchanged to the control of the hydraulic cylinder 11*a*, the pressure control valve 24*a*, and the electromagnetic selector valve 25*a* for the case where the boom 7 is brought into deformation of torsion so as to apply a larger pressing force to the hydraulic cylinder 11*a*; therefore, detailed description thereof will be omitted.

Also when the boom 7 is brought into deformation of torsion, conducted is a control similar to the control for the case of the deformation of lateral deflection in the boom 7. Specifically, when the boom 7 is brought into deformation of torsion so as to apply a large pressing force to the hydraulic cylinder 11*a*, the valve control section 21*b* controls the pressure control valve 24*a* so as to change the set pressure P1 of the pressure control valve 24*a* into the set pressure P2 higher than the set pressure P1. Furthermore, the valve control section 21*b* controls the electromagnetic selector valve 25*a* so as to switch the electromagnetic selector valve 25*a* from the current shutoff state to the communication state. The pump control section 21*c* controls the hydraulic pump 22 so as to supply hydraulic fluid to the hydraulic cylinder 11*a*. The foregoing controls makes it possible to supply hydraulic fluid to the hydraulic cylinder 11*a* with a pressure given an upper limit equal to the set pressure P2 to thereby provide the hydraulic cylinder 11*a* with an internal pressure great enough to resist a pressing force applied due to deformation of torsion in the boom 7. Thus making the thrust of the hydraulic cylinder 11*a* be larger than the thrust of the hydraulic cylinder 12*a* enables the stroke of the hydraulic cylinder 11*a* to be returned to an original stroke or a stroke close to the original stroke.

The control device 21 controls the supply device 20 so as to confine the difference between the stroke value of the hydraulic cylinder 11*a* and the stroke value of the hydraulic cylinder 12*a* within the predetermined range. The control device 21 according to the present embodiment controls the supply device 20 so as to bring the stroke value of the hydraulic cylinder 11*a* and the stroke value of the hydraulic cylinder 12*a* into coincidence with each other. In addition, if the stroke of the hydraulic cylinder 11*a* cannot be returned to an original stroke or a stroke close to the original stroke even with supply of hydraulic fluid to the hydraulic cylinder 11*a* with a pressure given an upper limit equal to the set pressure P2, the control device 21 controls the supply device 20, similarly to the above, so as to increase the set pressure of the pressure control valve 24*a* to bring the stroke value of the hydraulic cylinder 11*a* into coincidence with the stroke value of the hydraulic cylinder 12*a*.

Such control of the supply device 20 as to increase the stroke value of the hydraulic cylinder 11*a* which is smaller than the stroke value of the hydraulic cylinder 12*a* makes it possible to effectively reduce deformation of the boom 7 against a pressing force applied to the backstop 11 due to the deformation of torsion in the boom 7.

At the point in time when respective stroke values output from the stroke sensors 11*b* and 12*b* become equal to each other (alternatively, at the point in time when the stroke difference between the hydraulic cylinders 11*a* and 12*a* falls within the predetermined limit), the valve control section 21*b* switches the electromagnetic selector valve 25*a* to the shutoff state to prevent the stroke of the hydraulic cylinder 11*a* from decrease.

Subsequently, at the point in time when the torsion caused in the boom 7 is efficiently reduced or eliminated to make the stroke value of the hydraulic cylinder 12*a* input from the stroke sensor 12*b* be smaller than the stroke value of the hydraulic cylinder 11*a* input from the stroke sensor 11*b*, the valve control section 21*b* controls the pressure control valve 24*a* so as to return the set pressure P2 of the pressure control valve 24*a* to the set pressure P1. This causes the internal pressure of the hydraulic cylinder 11*a* to be also reduced to the set pressure P1, so that the internal pressures of the hydraulic cylinders 11*a* and 12*a* become equal to each other. When the torsion caused in the boom 7 is eliminated, the stroke values of both the hydraulic cylinders 11*a* and 12*a* become equal to each other. The operation for the deformation of torsion in the boom 7 is thus finished.

As described in the foregoing, in the crawler crane 100 according to the present embodiment, when the boom 7 is brought into deformation of lateral deflection or torsion, a control is conducted to make a first thrust the hydraulic cylinder 11*a* (or 12*a*) of one backstop 11 (or 12) of the pair of backstops 11 and 12, the one backstop receiving a larger pressing force applied due to the deformation of the boom 7 than a pressing force applied to the other backstop of the pair of backstops 11 and 12, be larger than a second thrust of the hydraulic cylinder 12*a* (or 11*a*) of the other backstop 12 (or 11). This control makes it possible to reduce the deformation of the boom 7 against a pressing force applied to the one backstop (the backstop 11 or 12). This enables deformation of the boom 7 to be suppressed with a simple configuration requiring no large-scale facility for suppressing deformation of the boom 7 and at low costs.

Application of a pressing force larger than an internal pressure of the hydraulic cylinder 11*a* (or 12*a*) to the hydraulic cylinder 11*a* (or 12*a*) of the backstop 11 (or 12) due to deformation of the boom 7 makes the stroke of the hydraulic cylinder 11*a* (or 12*a*) be shorter: this allows the judgment to be made that a larger pressing force is applied to one hydraulic cylinder 11*a* (or 12*a*) of the backstop 11 (or 12) with a smaller stroke value than the pressure force applied to the other hydraulic cylinder 12*a* (11*a*) of the backstop 12 (or 11). Thus, the control of the supply device 20 to increase a small stroke value of the hydraulic cylinder enables deformation of the boom 7 to be effectively reduced with a simple configuration against a pressing force applied to the backstop 11 (or 12).

In addition, the control device 21, controlling the supply device 20 so as to confine the difference between respective stroke values of the hydraulic cylinder 11*a* (or 12*a*) of the backstop 11 (12) and stroke value of the hydraulic cylinder 12*a* (or 11*a*) of the backstop 12 (or 11) within a predetermined limit, can effectively reduce deformation of the boom 7 with a simple configuration.

The present invention is not limited to embodiment described in the foregoing, but allows for various modifications as shown below as long as the modification is within the scope of claims for patent.

Judgment on the magnitude of a pressing force when the boom 7 is brought into deformation of lateral deflection or torsion is not limited to that based on a stroke value input from the stroke sensors 11*b* and 12*b* as in the embodiment. For example, it is also possible that the deformation sensing device includes strain gauges attached to right and left end portions of the boom 7 and the control device judges, on the basis of a value input from the strain gauge, which of pressing forces applied to the pair of backstops due to the deformation of the boom. Specifically, a judgement can be made that the pressing force applied to the backstop on the left side is larger than the pressing force applied to the backstop on the right side when a strain value input from the strain gauge attached to the left end portion of the boom is larger than a strain value input from the strain gauge attached to the right end portion, and that a pressing force applied to the backstop on the right side is larger than a pressing force applied to the backstop on the left side when the strain values are reverse. Also this mode can provide an effect similar to that in the above embodiment. The deformation sensing device according to the present invention may be one capable of sensing deformation of the boom other than lateral deflection or torsion. There can be used any deformation sensing device which obtains information about boom deformation allowing judgment on which of pressing forces applied to the pair of backstops due to the deformation is larger to be made.

The control device 21 according to the embodiment may control the supply device 20 so as to bring the stroke value of the hydraulic cylinder 11*a* (or 12*a*) of the backstop 11 (or 12) to which a pressing force is applied when the boom 7 is deformed into coincidence with the stroke value of the hydraulic cylinder 12*a* (or 11*a*) of the backstop 12 (or 11), or may control the supply device 20 so as to confine the difference of the stroke value of the hydraulic cylinder 11*a* (or 12*a*) of the backstop 11 (12) from the stroke value of the hydraulic cylinder 12*a* (or 11*a*) of the backstop 12 (or 11) within a predetermined limit. In other words, a slight difference may be permitted between the stroke values of the hydraulic cylinders 11*a* and 12*a* of the pair of backstops 11 and 12 if the difference is confined within an allowable range. The control device 21 only has to control the supply device 20 so as to make a thrust of the hydraulic cylinder of the backstop receiving a larger pressing force applied due to the deformation of the boom 7 be larger than a thrust of the hydraulic cylinder of the other backstop.

The present invention is not limited to a crawler crane, but allowed to be widely applied to construction machines equipped with a boom.

As described in the foregoing, provided is a construction machine including a boom, the construction machine being capable of suppressing deformation of the boom with a simple configuration and at low costs. The construction machine includes: a base; a slewing body mounted on the base so as to be slewable; a boom pivotally supported on the slewing body so as to be raised and lowered, the boom having a back surface; a pair of right and left backstops located between the back surface of the boom and the slewing body, each of the right and left backstops having a hydraulic cylinder which generates a thrust that pushes the boom forward in order to prevent the boom from falling backward, each of the backstops having a first end portion connected to the slewing body and a second end portion to be connected to the boom, the second end portion being opposite to the first end portion; a supply device which supplies each hydraulic cylinder of the pair of backstops with hydraulic fluid for generating the thrust; a deformation sensing device which senses deformation of the boom; and a control device which controls the supply device such that the supply device supplies hydraulic fluid so as to make a first thrust of the hydraulic cylinder of one backstop of the pair of back stops be larger than a second thrust of the hydraulic cylinder of the other backstop of the pair of back stops, the one backstop receiving a larger pressing force applied due to deformation of the boom than the pressing force applied to the other backstop, the deformation being sensed by the deformation sensing device.

The control device, which conducts such a control of the supply device that the first thrust of the hydraulic cylinder of one backstop of the pair of backstops, the one backstop receiving a larger pressing force due to the deformation of lateral deflection, torsion or the like in the boom, becomes larger than the second thrust of the hydraulic cylinder of the other backstop, allows the deformation of the boom to be reduced against the pressing force applied to the one backstop. This makes it possible to suppress deformation of the boom with a simple configuration requiring no large-scale facility for suppressing deformation of the boom and at low costs.

For example, the deformation sensing device preferably senses deformation of lateral deflection or torsion in the boom.

It is preferable that the deformation sensing device includes a pair of stroke sensors which detect respective stroke values of the hydraulic cylinders included in the pair of backstops, respectively, and the control device controls the supply device so as to increase a smaller stroke value of one hydraulic cylinder of the hydraulic cylinders of the pair of backstops, the stroke value being sensed by the stroke sensor. When a pressing force larger than an internal pressure of the hydraulic cylinder is applied to the hydraulic cylinder due to deformation of the boom, the stroke of the hydraulic cylinder is reduced; this allows a judgment to be made that a larger pressing force is applied to the hydraulic cylinder having a smaller stroke than the hydraulic cylinder having a smaller stroke value. Hence, controlling the supply device to increase the smaller stroke value of the hydraulic cylinder makes it possible to reduce deformation of the boom effectively with a simple configuration against a pressing force applied to the backstop including the hydraulic cylinder having the smaller stroke value.

The control device preferably controls the supply device so as to confine the difference of the stroke value of the hydraulic cylinder of one of the pair of backstops from the stroke value of the hydraulic cylinder of the other backstop within a predetermined limit. This enables deformation of the boom to be effectively reduced with simple control.

This application is based on Japanese Patent application No. 2016-221790 filed in Japan Patent Office on Nov. 14, 2016, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A construction machine comprising:

a base;

a slewing body mounted on the base so as to be slewable;

a boom pivotally supported on the slewing body so as to be raised and lowered, the boom having a back surface;

a pair of right and left backstops located between the back surface of the boom and the slewing body, each of the right and left backstops having a hydraulic cylinder which generates a thrust that pushes the boom forward in order to prevent the boom from falling backward, each of the backstops having a first end portion connected to the slewing body and a second end portion to be connected to the boom, the second end portion being opposite to the first end portion;

a supply device which supplies each hydraulic cylinder of the pair of backstops with hydraulic fluid for generating the thrust;

a deformation sensing device which senses deformation of the boom; and a control device which controls the supply device such that the supply device supplies hydraulic fluid so as to make a first thrust of the hydraulic cylinder of one backstop of the pair of back stops be larger than a second thrust of the hydraulic cylinder of the other backstop of the pair of back stops, the one backstop receiving a larger pressing force applied due to deformation of the boom than the pressing force applied to the other backstop, the deformation being sensed by the deformation sensing device.

2. The construction machine according to claim 1, wherein the deformation sensing device senses deformation of lateral deflection or torsion in the boom.

3. The construction machine according to claim 1, wherein the deformation sensing device includes a pair of stroke sensors which detect respective stroke values of the hydraulic cylinders included in the pair of backstops, respectively, and the control device controls the supply device so as to increase a smaller stroke value of one hydraulic cylinder of the hydraulic cylinders of the pair of backstops, the stroke value being sensed by the stroke sensor.

4. The construction machine according to claim 3, wherein the control device controls the supply device so as to confine the difference of the stroke value of the hydraulic cylinder of one of the pair of backstops from the stroke value of the hydraulic cylinder of the other backstop within a predetermined limit.

* * * * *